US005371518A

United States Patent [19]

Hannah

[11] Patent Number: 5,371,518

[45] Date of Patent: Dec. 6, 1994

[54] VIDEO TIMING AND DISPLAY ID GENERATOR

[75] Inventor: Marc Hannah, Mountain View, Calif.

[73] Assignee: Silicon Graphics, Inc., Mountain View, Calif.

[21] Appl. No.: 842,930

[22] Filed: Feb. 27, 1992

[51] Int. Cl.[5] ..... G09G 1/14

[52] U.S. Cl. ..... 345/200; 345/213

[58] Field of Search ..... 340/750, 814, 726, 723, 340/724, 798, 799, 749; 345/27, 28, 196, 197, 198, 200, 201, 203, 213, 214; 395/425

[56] References Cited

U.S. PATENT DOCUMENTS

| | | | |
|---|---|---|---|
| 4,404,554 | 9/1983 | Tweedy, Jr. et al. | 345/27 |
| 4,642,794 | 2/1987 | Lavell et al. | 340/726 |
| 4,742,350 | 5/1988 | Ko et al. | 340/799 |
| 4,775,859 | 10/1988 | Starkey, IV et al. | 345/27 |
| 4,777,485 | 10/1988 | Costello | 340/798 |
| 4,814,884 | 3/1989 | Johnson et al. | 340/799 |
| 4,837,563 | 6/1989 | Mansfield et al. | 340/724 |
| 4,958,227 | 9/1990 | Wan | 340/814 |
| 4,958,304 | 9/1990 | Moore | 340/799 |
| 5,030,946 | 7/1991 | Yamamura | 340/750 |
| 5,136,695 | 8/1992 | Goldshlag et al. | 340/799 |

*Primary Examiner*—Tommy P. Chin
*Assistant Examiner*—A. Au
*Attorney, Agent, or Firm*—Blakely, Sokoloff, Taylor & Zafman

[57] ABSTRACT

An apparatus and a method of generating video timing information and display ID information wherein the video timing generator includes a memory, typically a random access memory, which stores video timing information. A control logic device couples the information from memory to a FIFO. The control device further couples the initial information from the FIFO to a second memory, typically a register, and a sequential counter. After initial loading of information in the second memory and sequential counter, the sequential counter determines when the second memory and itself will be loaded with the next set of information. Once the sequential counter reaches zero, it generates a signal enabling itself and the second memory to load the next set of information. The display ID generator includes a memory which stores display ID information. A control logic device couples the information from the memory to a first FIFO. A state machine accesses the information held in the first FIFO and determines the duration information. Next, the state machine couples the information to a second FIFO. Last, the information in the second FIFO is coupled to a third memory and a sequential counter. After initial loading of information in second memory and sequential counter, the sequential counter determines when second memory and itself will be loaded with the next set of information. Once the sequential counter reaches zero, it generates a signal enabling itself and the second memory to load the next set of information.

14 Claims, 16 Drawing Sheets

| | LINE TABLE |
|---|---|
| LINE 1 | State, Duration |
| | State, Duration |
| | " |
| | " |
| | " |
| | State, Duration (**EOL**) |
| LINE 2 | State, Duration |
| | State, Duration |
| | " |
| | " |
| | " |
| | State, Duration (**EOL**) |
| | " |
| | " |
| | " |
| | " |
| | " |
| | " |
| LINE n | State, Duration |
| | State, Duration |
| | " |
| | " |
| | " |
| | State, Duration (**EOL**) |

| FRAME TABLE |
|---|
| L1 |
| L2 |
| L3 |
| L3 |
| L5 |
| " |
| " |
| " |
| " |
| Ln |
| L2 |
| L4 |
| Ln |
| " |
| " |
| " |
| " |

FIGURE 3a (Prior Art)

FIGURE 3b (Prior Art)

LINE SEQUENCE TABLE

| | |
|---|---|
| LINE 1: | State, Duration |
| | State, Duration |
| | " |
| | " |
| | " |
| | " |
| | EOL Flag |
| | Pointer to Next Line |
| LINE 2: | State, Duration |
| | State, Duration |
| | " |
| | " |
| | " |
| | EOL Flag |
| | Pointer to Next Line |
| | " |
| | " |
| | " |
| | " |
| | " |
| | " |
| LINE n: | State, Duration |
| | State, Duration |
| | " |
| | " |
| | " |
| | EOL Flag |
| | Pointer to Next Line |

FIGURE 7a

FRAME TABLE

| |
|---|
| Total Number of lines in The Frame |
| Pointer to line sequence 1 |
| Number of lines in sequence1 |
| Pointer to line sequence 2 |
| Number of lines in sequence 2 |
| " |
| " |
| " |
| " |
| " |
| " |
| Pointer to line sequence n |
| Number of lines in sequence n |

FIGURE 7b

LINE SEQUENCE TABLE

| | |
|---|---|
| LINE 1 (L1): | State, Duration |
| | " |
| | " |
| | EOL Flag |
| | Pointer to line 2 |
| LINE 2 (L2): | State, Duration |
| | " |
| | " |
| | EOL Flag |
| | Pointer to line 5 |
| LINE 3 (L3): | State, Duration |
| | " |
| | " |
| | EOL Flag |
| | Pointer to line 4 |
| LINE 4 (L4): | State, Duration |
| | " |
| | " |
| | EOL Flag |
| | Pointer to line 3 |
| LINE 5 (L5): | State, Duration |
| | " |
| | " |
| | EOL Flag |
| | Pointer to line 1 |
| LINE 6 (L6): | State, Duration |
| | " |
| | " |
| | EOL Flag |
| | Pointer to line 6 |

FIGURE 8a: Typical line sequence table

FRAME TABLE

Total Number of lines in The Frame = 11
Pointer to line sequence 1 = L2
Number of lines in sequence1 = 5
Pointer to line sequence 2 = L3
Number of lines in sequence 2 = 3
Pointer to line sequence n = L6
Number of lines in sequence = 3

FIGURE 8b: typical frame table entry

| |
|---|
| L2 |
| L5 |
| L1 |
| L2 |
| L5 |
| L3 |
| L4 |
| L3 |
| L6 |
| L6 |
| L6 |

FIGURE 8c: Interpretation of the frame table

SCANLINE TABLE

| | |
|---|---|
| LINE 1: | Word Count |
| | DID, X start |
| | " |
| | " |
| | " |
| LINE 2: | Word Count |
| | DID, X start |
| | " |
| | " |
| | " |
| | " |
| | " |
| | " |
| Line n: | Word Count |
| | DID, X start |
| | " |
| | " |

Figure 13a: Example of line table

FRAME TABLE

Pointer to 1st line entry
Pointer to 2nd line entry
"
Line Repeat Count
"
"
"
Pointer to nth line entry
"
Line Repeat Count
"
"
"
"
"
"
"

Figure 13b: Example of frame table

VIDEO TIMING AND DISPLAY ID GENERATOR

FIELD OF THE INVENTION

The present invention relates generally to computer display systems and more particularly to an apparatus generating video timing signals and an apparatus generating display ID (identification) information for controlling information displayed on a computer display.

BACKGROUND OF THE INVENTION

Interactive computer systems include a display device, such as a Cathode Ray Tube (CRT) or a liquid crystal display which enables the system to display information generated by the computer. Often, the display device is a raster scanned device. A typical display mechanism of a computer is shown in FIG. 1. Memory 10 contains the information about the individual pixels that are displayed on the display monitor 22. This information is provided to the memory 10 by the host computer over bus 9. Video controller 12 determines what information needs to be accessed from memory 10, which is often Video RAM (VRAM), then accesses the memory to obtain the information. The information is passed on to RAMDAC 14 which converts the digital information to an analog signal carried by the signal lines 16, 18, and 20. The signal lines are connected to the red, green, blue input of the display monitor 22. Once the display monitor 22 receives the signals, it generates on the screen the image that is represented by the information on the signal lines.

An important part of the display circuit is the video controller 12. Its most important task is to constantly refresh the display. In this process, the video controller 12 has to generate control signals for controlling various components, access the memory and fetch the information, possibly transform the information or interpret the information, and transfer the information to the RAMDAC 14. All of these tasks are done by different modules that form the video controller 12. Among the modules within the video controller 12 are Video Timing Generator (for generating video timing information for the display device) and Display ID generator (for generating display mode information).

FIG. 2 shows a typical prior art implementation of a video timing generator. This implementation may be found in prior art computer systems including the Personal Iris computer from Silicon Graphics of Mountain View, Calif. Memory 20 is coupled to the Address Counter 25 which generates the address of the information desired by the video timing generator circuit. Memory 20 may be part of memory 10 or may be separate memory. The Address Counter 25 addresses memory 20 via address bus 27. The information contained in the addressed memory location is transferred to the State Register 22 and Run Counter 23 via Data Bus 28. The State Machine 21 looks at the information out of memory 20 and determines whether the information should be loaded in State Register 22 and Run Counter 23, or it should be interpreted to determine the next step in the process.

It will be appreciated that memory 20 contains two tables, line table and frame table, which hold the video timing information. An example of the line table and frame table can be seen in FIGS. 3*a* and 3*b* respectively. The frame table contains a starting address to each line in the particular frame. The line table contains information representing the state and duration of the state for each line in a frame. A plurality of state and duration combination represent one line and is terminated by a state and duration information that is decoded by the state machine 21 to signal the end of a particular line ("EOL"). Each state represents a plurality of timing signals (e.g. composite Synch) which exist on the line for a group of consecutive pixels and the number of pixels in the group are represented by the duration of the state. A single pixel could be a group, although this is rare.

The function of the Video Timing Generator can be better understood using the flowchart of FIG. 4. The first step is to load the address of the first line in the frame table into the line counter (box 42). This will enable the system to address the memory location in the line table and get the first state and duration information in the first line (box 44). The state and duration information is then respectively loaded in state register 22 and run counter 23 of FIG. 2. The state information represents the state, high or low state, of timing signals for a group of pixels and the duration information tells the system the number of times (pixels) each state holds. Once the duration information is loaded in the run counter, it starts to count down to zero. Once run counter has reached zero (box 47), it will generate a signal which enables the state register and run counter to be loaded with the next state and duration information in the particular line. The system will continue until state machine 21 in FIG. 2 detects the end of the line (EOL) information (box 46). To detect the EOL information, state machine 21 (FIG. 2) looks for a predetermined set of bits and if any state and duration combination matches that predetermined set of bits, the state machine generates a signal to load in the address of the next line listed in the frame table (box 48).

After the new address is loaded, the state machine 21 (FIG. 2) checks the new address to see whether the end of the frame has been reached (box 49). If the end of the frame is reached (i.e. the answer to the question in box 49 is yes), the address of the first line in the frame will be loaded into line counter. If the end of the frame table is not detected (i.e. the answer to the question in box 49 is no), state machine 21 (FIG. 2) loads the state and duration information of the new line into the state register 22 and run counter 23 (FIG. 2). This process continues until the system is aborted.

In order for the memory in the prior art to work with any pixel clock rate, it has to be able to handle the frequency of such pixel clock rate. This requirement limits the performance of prior art devices where the clock rate is so high that readily available memory cannot service that rate and consequently, more expensive, exotic high speed memory is required. Furthermore, such high speed memory eliminates any possibility of allowing other modules in the video controller to use the memory capacity. Thus, memory for the video timing cannot be shared with other uses, such as display ID information.

Regarding the Display ID generator, the prior art uses the same architecture discussed above for the video timing generator, such as the architecture shown in FIG. 2. Hence, all the disadvantages mentioned above apply to a typical prior art Display ID generator.

The present invention discloses an apparatus and a method to generate video timing information and Display ID information where the memory does not have to be as fast as the pixel clock rate is. Further, by eliminating high speed compatibility requirements for the memory, it can be shared among all the modules forming the video controller circuit.

SUMMARY OF THE INVENTION

The invention provides an improved video timing generator and display ID generator that function at high pixel clock rates using readily available random access memory. The invention eliminates the need for very fast memory and allows the video timing and display ID information to share space in the same memory.

The video timing generator includes a memory means, typically a random access memory, which stores video timing information. A control means couples the information from memory means to a FIFO. A control means further couples the initial information from the FIFO to a second memory means, typically a register, and a sequential counter. After initial loading of information in the second memory means and sequential counter, the sequential counter determines when the second memory and itself will be loaded with the next set of information. Once the sequential counter reaches zero, it generates a signal enabling itself and the second memory means to load the next set of information.

In a preferred embodiment of the present invention, video timing information is stored in the memory in two different tables. The first table contains the information pointing to the entries of the second table. The second table contains the information that will be generated by the video timing circuit. The control means reads the information and couples it to the FIFO at an average state transition rate which is lower than the pixel clock rate. This allows slower memory to be used to load the FIFO at the slower clock rate but the FIFO can be emptied at the pixel clock rate because the FIFO can be fabricated in fast logic gates which may operate at very high rates. Next the information is transferred to the state register and the sequential counter at pixel clock speed. The output of the state register is the desired information.

The display ID generator includes a memory means which stores display ID information. A control means couples the information from the memory means to a first FIFO. A state machine accesses the information held in the first FIFO and determines the duration information. Next, the state machine couples the information to a second FIFO. Last, the information in the second FIFO is coupled to a third memory and a sequential counter. After initial loading of information in second memory means and sequential counter, the sequential counter determines when the third memory and itself will be loaded with the next set of information. Once the sequential counter reaches zero, it generates a signal enabling itself and the third memory means to load the next set of Display ID information.

In a preferred embodiment of the present invention, the Display ID information stored in the memory means is in two tables. First table contains information that points to the entries of the second table. Second table contains the Display ID information.

BRIEF DESCRIPTION OF THE DRAWINGS

FIGS. 3*a* and 3*b* shows the content of the two tables holding the video timing information in the prior art.

FIGS. 7*a* and 7*b* shows a typical example of the information contained in the two tables in the memory of the preferred embodiment of the present invention.

FIGS. 8*a*, 8*b*, and 8*c* shows an example of the typical contents of a line sequence table and a frame table.

FIGS. 13*a* and 13*b* shows a typical example of the Display ID information contained in the two tables in the memory of the preferred embodiment of the present invention.

DETAILED DESCRIPTION OF THE PRESENT INVENTION

The following description will refer to specific architectures, circuits, specific control signals and data conversion methods in order to provide a complete understanding of the present invention. It will be appreciated that these specific details are provided for purposes of illustration and are not to be construed to limit the scope of the invention; moreover, it will be appreciated that many variations and modifications can be made by those in the art based upon the description provided here.

Video Timing Generator

Figure 1:
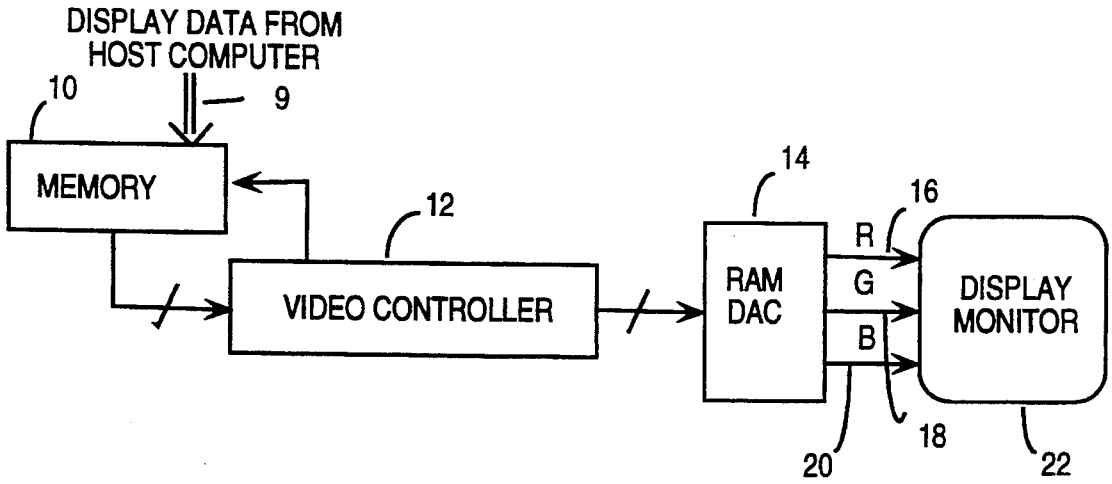
FIGURE 1 (Prior Art)
FIG. 1 shows a typical video portion of a computer controlled display system.
Figure 5:
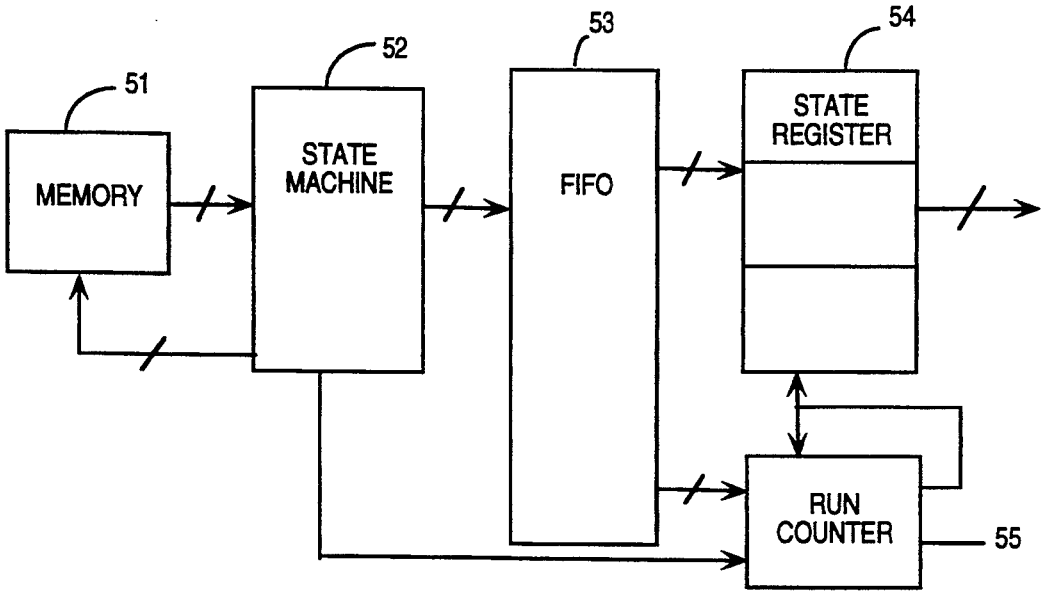
FIG. 5 shows a block diagram of video timing generator according to the present invention.

FIG. 5 shows a block diagram of a Video Timing Generator according to the present invention; this video timing generator includes a memory 51, state machine 52, FIFO (first-in-first-out buffer) 53, state register 54, and run counter 55. The memory 51 contains the video timing information. A particular memory location in memory 51 is accessed by the state machine 52 to get state and duration information for a particular state in a scan line. The information is then transferred to FIFO 53 from state machine 52. The information transferred to FIFO 53 consists of two portions: a state portion and a duration portion. Upon certain conditions the state portion of the information is loaded into state register 54 and the duration portion is loaded into the run counter 55. The output of state register 54 is the video timing information to be passed to RAMDAC 14 in FIG. 1.

Figure 6:
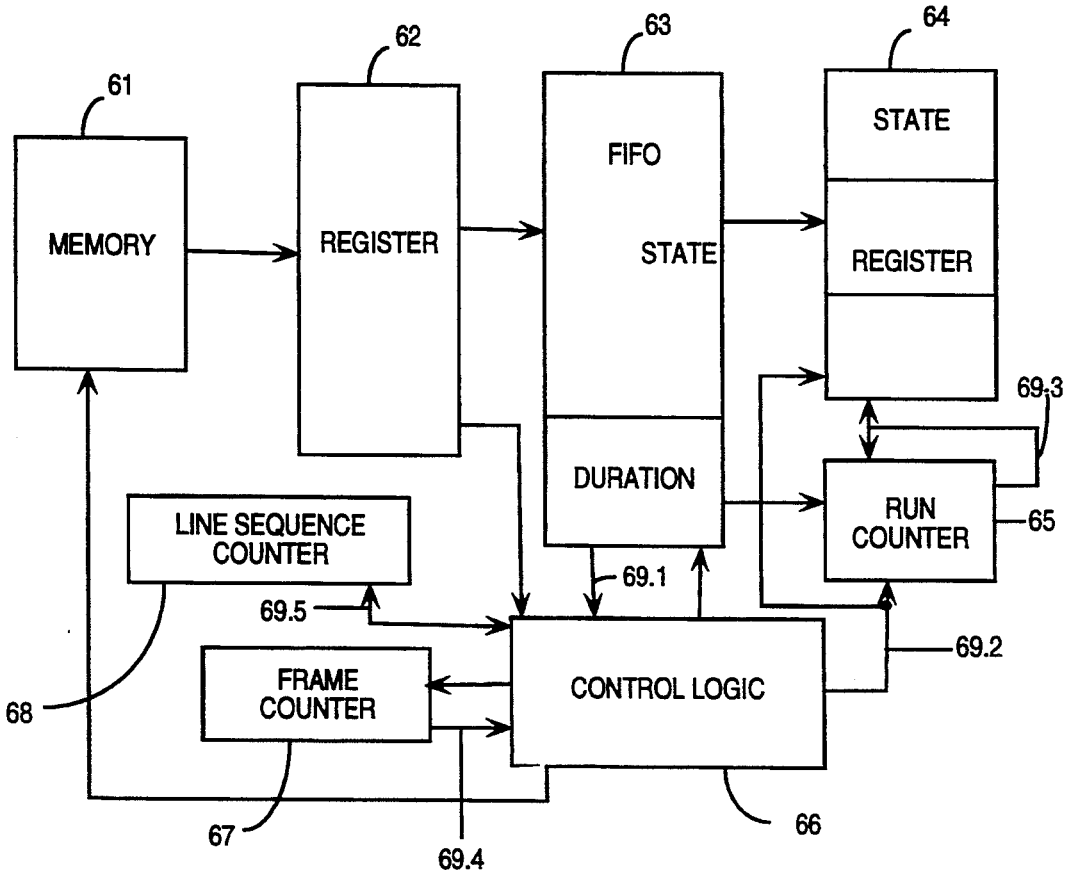
FIG. 6 shows a preferred embodiment of the present invention generating video timing signal.

FIG. 6 is a detailed version of the video timing generator of FIG. 5. It will be appreciated that state machine 52 of FIG. 5 contains register 62, controller 66, frame counter 67, and line sequence counter 68. A more detailed explanation of the function of each component will be furnished next.

The video timing information in memory 61 is stored in two different tables shown in FIGS. 7*a* and 7*b*. Before explaining the tables, it is useful to define a few terms. A "STATE " defines the value of each timing signal (in the collection of video timing signals which are typically provided to the RAMDAC 14). A "DURATION" defines how many clocks each state lasts (this represents the number of consecutive pixels across a scan line which has the same state). A "LINE" is a list of state and duration combinations and is intended to correspond to one horizontal line (scan line) of the display device such as a CRT monitor. A"LINE SEQUENCE" is a circular linked list of lines. A "LINE SEQUENCE RUN" defines a line sequence, along with how many lines the sequence repeats. Finally, a "FRAME" is defined by a list of line sequence runs. FIGS. 8*a*, 8*b*, and 8*c* show an example of a line, a line sequence, and a line sequence run.

FIG. 7*a* is a typical example of a line sequence table stored in memory 61 of the preferred embodiment of present invention. It contains a collection of lines linked by pointers. Each line consists of a collection of state and duration combinations which is called a state run. A state run contains at least one byte of information representing the state and one byte of information representing the duration of the particular state. Every state run must contain at least one byte state and one byte duration information, although every state run could contain up to 3 bytes of state information. If a state run contains more than one byte of state information and the second byte or the third byte state information does not change from the previous state, the second or third byte may be omitted. Each line ends with a one byte of information denoting the end of the line (EOL). The next two bytes of information after the EOL byte point to the next line in the line sequence. This will allow the system to continue getting the information within a line sequence without referring back to the frame table for the address of the next line, as it is done in prior art.

FIG. 7*b* is a typical example of a frame table stored in memory 61 of preferred embodiment of this invention. The frame table consists of at least two bytes of information denoting the total number of lines in the frame followed by a list of fine sequence run entries. Each line sequence run contains a two byte pointer to the first line of a line sequence and one byte specifying how may lines are in the line sequence.

FIG. 8 gives an example of entries in a line sequence table and a frame table. FIG. 8*a* represents the entries of a typical line sequence table. FIG. 8*b* is a typical frame table that includes the number of lines in the frame (equal to 11), first line sequence run staring at line 2 (L2) containing five lines, second line sequence run starting at line 3 containing 3 lines, and the last line sequence run starting at line 6 with three lines in that sequence. FIG. 8*c* shows the interpretation of data in frame table of FIG. 8*b*, and the physical implementation of FIG. 8*c* is explained in the following paragraphs.

Figure 11:
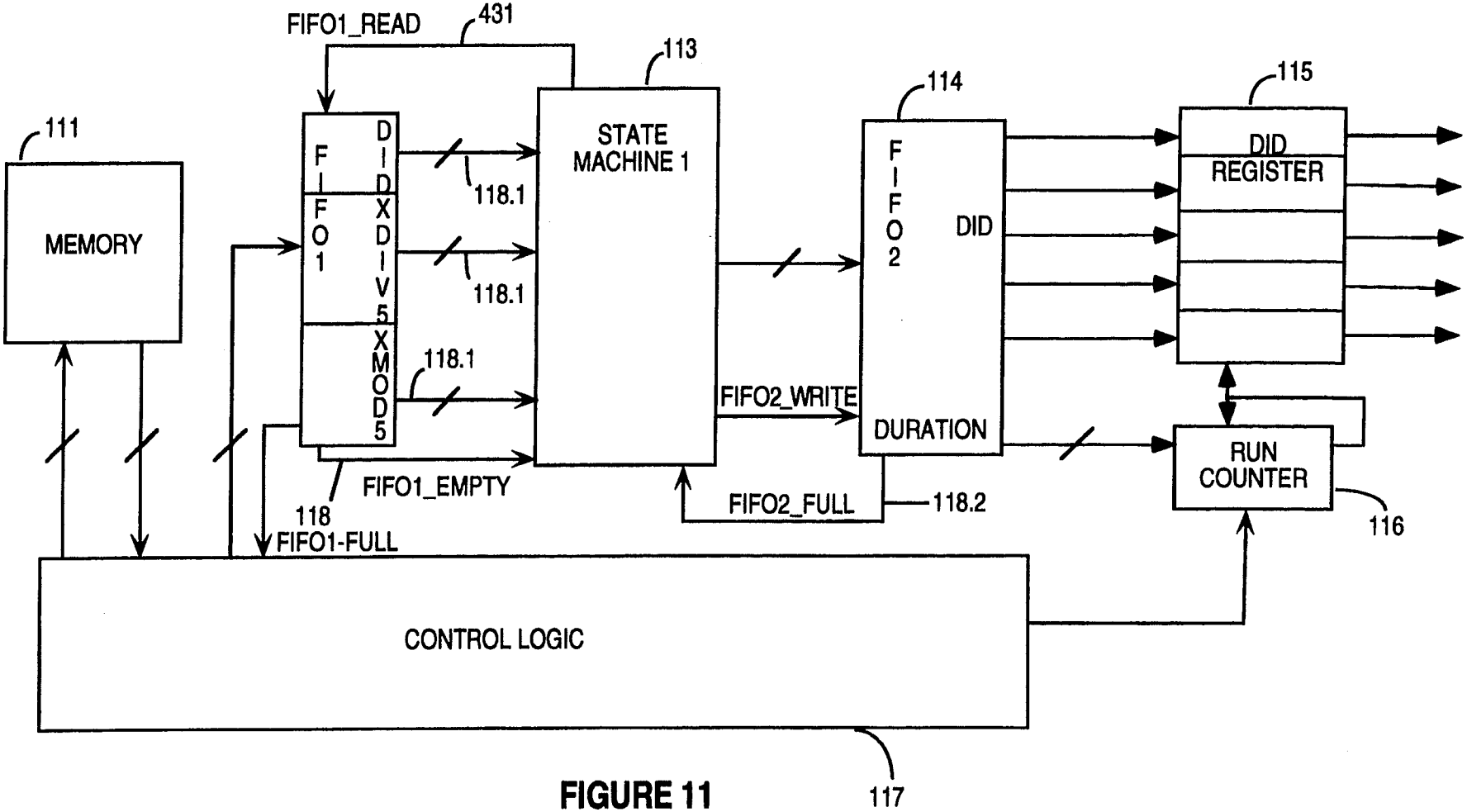
FIG. 11 shows a preferred embodiment of a Display ID generator according to the present invention.

Referring back to FIG. 6, the control logic 66 reads the information representing the number of lines in a particular frame from the frame table in memory 61 and loads the information in the frame counter (FC) 67. For example, in the case of the table in FIG. 8*b*, 11 is loaded into counter 67. Following this step, the control logic 66 reads the address of a line sequence from the frame table which is the address to the first line in any particular line sequence. In the case of the first line of the first line sequence of FIG. 8*b*, the address to line 2 is read by control logic 66. Next, the control logic 66 reads the number of lines in a line sequence from the frame table and loads the information into line sequence counter (LSC) 68. For example, in the case of the line sequence 1 in FIG. 8*b*, 5 is loaded into line sequence counter 68. Using the address to the first line of a line sequence, the control logic 66 accesses the memory location pointed to by the address to get the state and duration information in the first state run of the first line. The number of clock cycles needed to get the information in a particular state run depends on the number of bytes of information in any state run. If there is only one byte of state information in a state run, two clock cycles are needed to get the information in that particular state run.

Next, the state and duration information is loaded into the register 62. If FIFO 63 is not full, the information in the register 62 will be loaded into the FIFO 63, otherwise, the system waits until it can write in FIFO 63. The signal line 69.1 from FIFO 63 tells the control logic 66 whether FIFO 63 is full.

To load the initial state and duration information from FIFO 63 for a particular frame into state register 64 and run counter 65, control logic 66 generates a load control signal using signal line 69.2 to load the state and duration information. Once the initial duration is loaded into run counter 65, it starts to down count to zero. Once the run counter 65 reaches zero it sends a signal via signal line 69.3 to enable both state register 64 and itself to load in the next state and duration information stored in the FIFO 63. From this time on, the run counter 65 determines when the state register 64 and itself are loaded with next state and duration information from FIFO 63. The state and duration information of a particular line are systematically loaded into state register 64 and run counter 65. The system has been designed so that run counter 65 continually loads the state and duration registers (after the initial state of a particular frame) because the control logic 66 will be constantly loading the FIFO 63.

FIFO 63 is systematically loaded from register 62 under the control of control logic 66. Control logic 66 attempts to keep the FIFO 63 as full as possible by continually loading that FIFO with state and duration information from memory 61. Thus, for a particular line, control logic 66 sequentially retrieves the state and duration information until it reaches an EOL flag. Upon detecting the end of the line, control logic 66 loads in the address to the next line into the control logic 66 unit from the memory location immediately after the memory location storing the end of the line information. This will enable the control logic 66 unit to access the state and duration information of the next line in the line sequence and load that information into the FIFO 63. It will be appreciated that once the end of existing line is detected, the next location may point to the existing line itself (see the last pan of FIGS. 8*a* and 8*c*).

During the process of loading the FIFO 63, the LSC 68 and FC 67 are counting down toward zero. Each EOL signal causes the control logic 66 to signal to the LSC 68 and FC 67 to count down once to zero. Once LSC 68 reaches zero, it signals control logic 66 via line 69.5. Upon reception of the signal from LSC 68, control logic 66 will access memory 61 to get the address to the next line sequence in the frame table. For example, after counting the 5 lines in the line sequence I of FIG. 8*b*, the control logic 66 will access the frame table in memory 61 to get the address of the first line (L3) in the line sequence 2. This process will continue until FC 67 reaches zero. Once FC 67 reaches zero, it sends a signal to control logic 66 via signal line 69.4 indicating that the end of the frame has been reached. Upon reception of this signal, control logic 66 will load the address to the beginning of the frame table and repeats the above process all over again.

Figure 9:
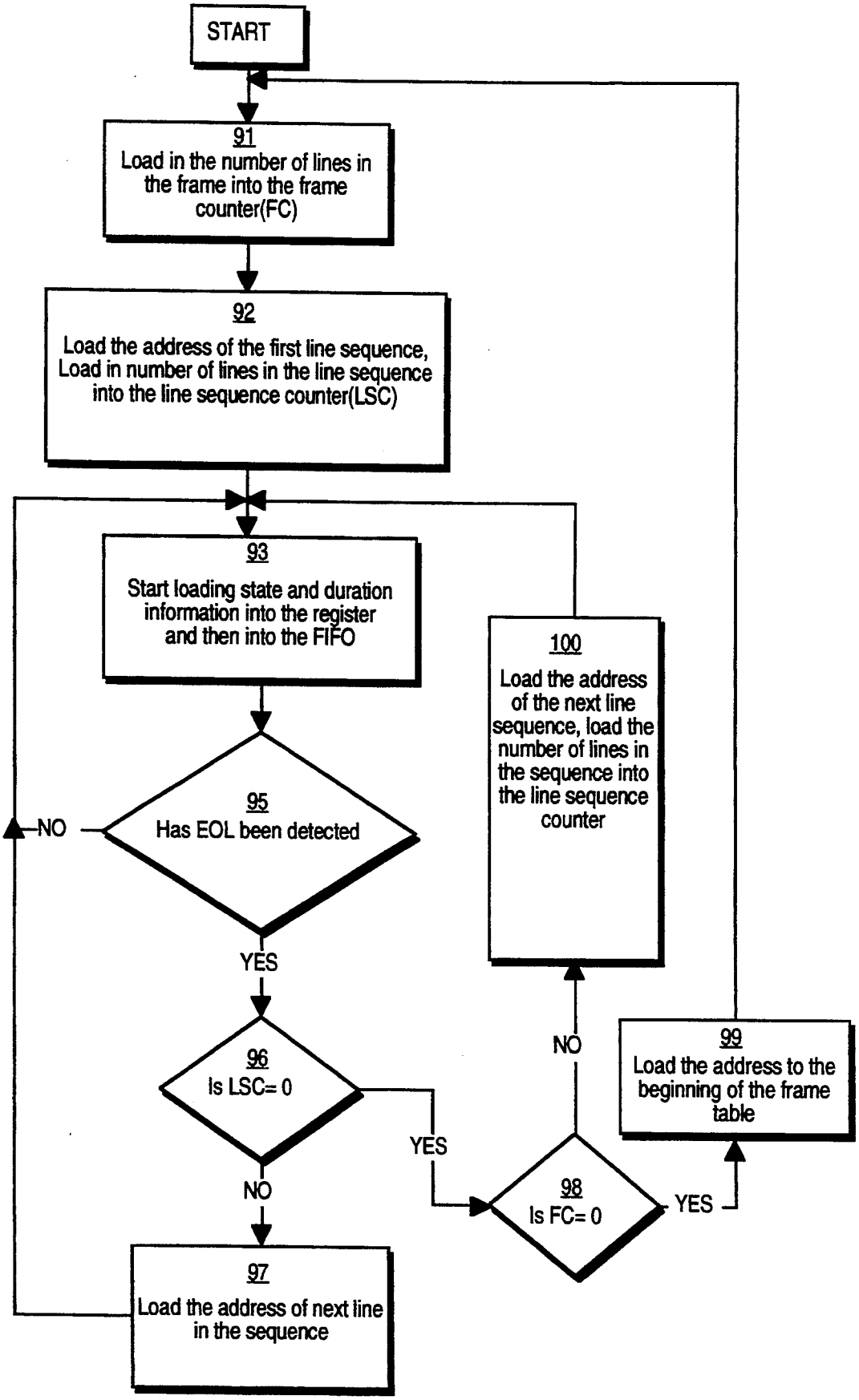
FIG. 9 shows a flow chart representing the steps taken by the preferred embodiment of the present invention in generating the video timing signal.

The flow chart in FIG. 9 shows the steps of generating the video timing signal. The process starts by loading the number of lines in a particular frame into the frame counter (FC) (box 91). Next the address of the first line sequence (pointer to the first line sequence after the number of lines in the frame) is loaded into the control logic 66 which retains the information and uses it later(box 92). The information about the number of lines in a line sequence is loaded into the line sequence counter in the same stage. Using the address to the first line in the line sequence, the state and duration information are loaded into register 62 and then into the FIFO 63 (box 93). The control logic 66 checks for EOL information when reading the state and duration information from the memory (box 95). Upon detection of EOL, control logic 66 checks to see whether LSC has reached zero (box 96). If LSC has not reached zero, control logic loads the address of next line in the line sequence (box 97) and returns to box 93. If LSC has reached zero, control logic checks to see whether FC has reached zero. If FC has reached zero, control logic 66 loads the address to the beginning of the frame table (box 99) and returns to box 91. If FC has not reached zero, control logic loads the address of the next line sequence in the frame table and loads the number of lines of that line sequence into the LSC 68 (box 100) and returns to box 93. It should be noted that each time that the system returns to any particular box in the flow chart, it follows the flow of the flow chart systematically. This process continues until the system is told to stop.

During the process of loading the FIFO 63, the run counter 65 causes the loading of the state register 64 and the counter 65 in the manner described above. That is, when the counter 65 reaches zero, it causes the state register 64 and the counter 65 to be loaded with the next state and duration information from the FIFO 63. The run counter 65 is checked at every pixel clock to determine whether its state/contents are equal to zero. In the middle of the line sequence or between line sequences, a zero in the run counter 65 indicates that the prior duration (and hence video timing state) has been completed and thus a new state and duration will be loaded into the state register 64 and run counter 65 respectively.

The discussed apparatus and method for generating video timing signal eliminates the dependency of memory selection on pixel clock rate. The preferred embodiment of present invention allows the transfer of information from memory 61 to FIFO 63 (see FIG. 6) at a slower clock rate than the pixel clock rate. However, the FIFO 63 has to be able to transfer information to the state register 64 and run counter 65 at a maximum pixel clock rate. A FIFO that can operate at a high pixel clock rate can be obtained from available technology, whereas a random access memory that operates at such high clock rate is very expensive and at very high rates might not be available. Furthermore, since the memory does not have to operate at such a high clock rate, it can be shared with other modules of video controller 12 in FIG. 1. Since there is no need for the memory in the present invention to operate at high clock rate and since it can share its storage capacity, present invention is more cost effective and can be realized much easier.

Display ID Generator

Figure 10:
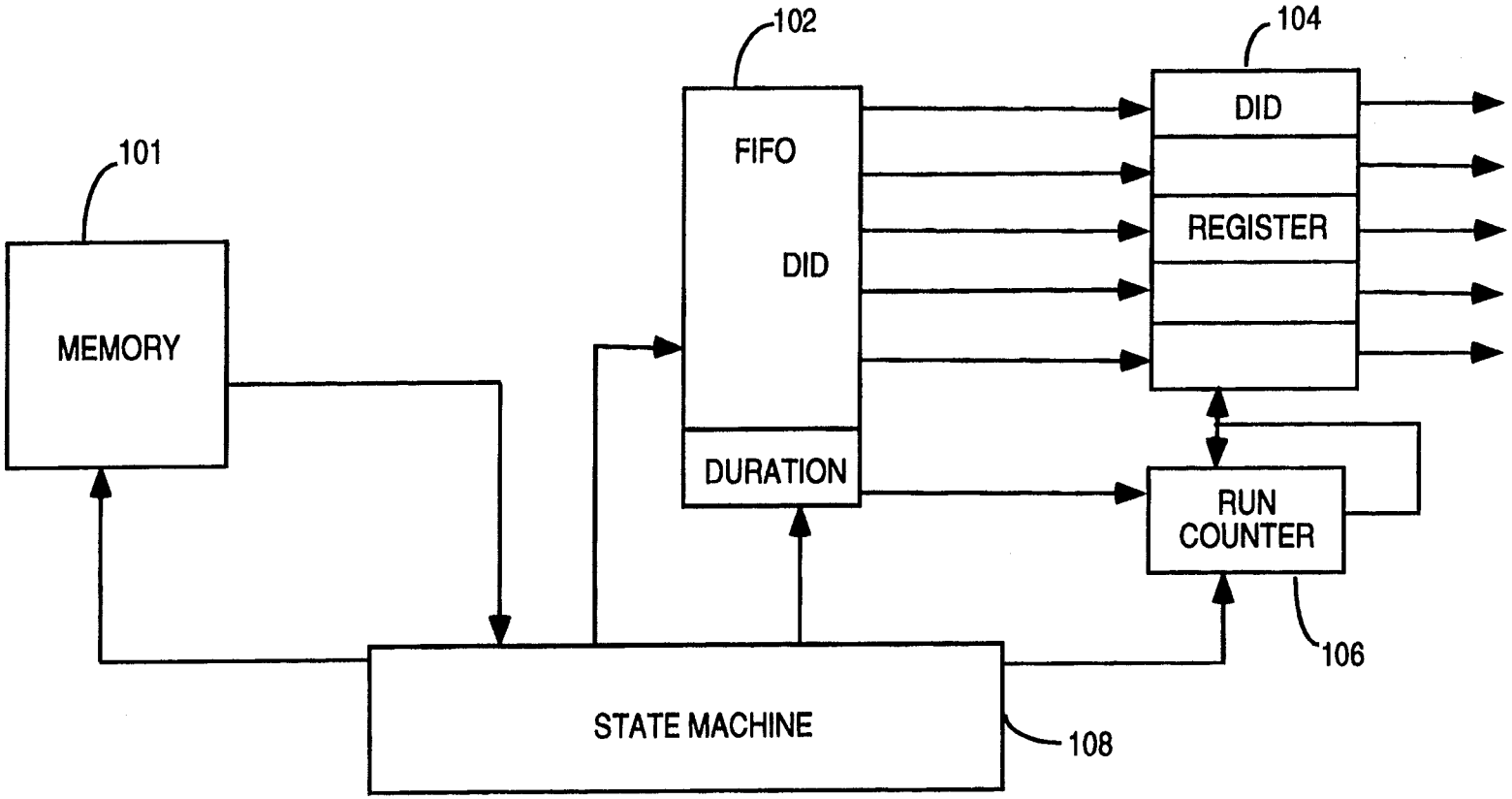
FIG. 10 shows a Display ID generator according to the present invention.

FIG. 10 shows a block diagram of a display ID generator according to the present invention; this display ID generator includes a memory 101, state machine 108, FIFO 102, DID register 104, and run counter 106. The memory 101 contains the display ID information that needs to be generated by the video controller 12 of FIG. 1. State machine 108 accesses a particular memory location in memory 101 to get display ID information. State machine 108 causes this information to be transferred to FIFO 102. Last, the information is loaded into DID register 104 and run counter 106. The output of DID register 104 is the display ID information which is passed on to the other parts of the display system and used in the customary manner.

FIG. 11 is a detailed version of the display ID generator shown in FIG. 10. It will be appreciated that state machine 108 in FIG. 10 contains FIFO1 112, state machine 113, and control logic 117. A more detailed explanation of the function of each element will be provided next. The preferred embodiment shown in FIG. 11 provides 5 consecutive DID values from register 115 in order to accelerate the output of DID values in situations where the pixel clock rate is very high. This parallel output may be serialized by a multiplexor in a manner which is similar to that shown in applicant's copending application Ser. No. 07/732,793, filed Jul. 19, 1991.

Figure 2:
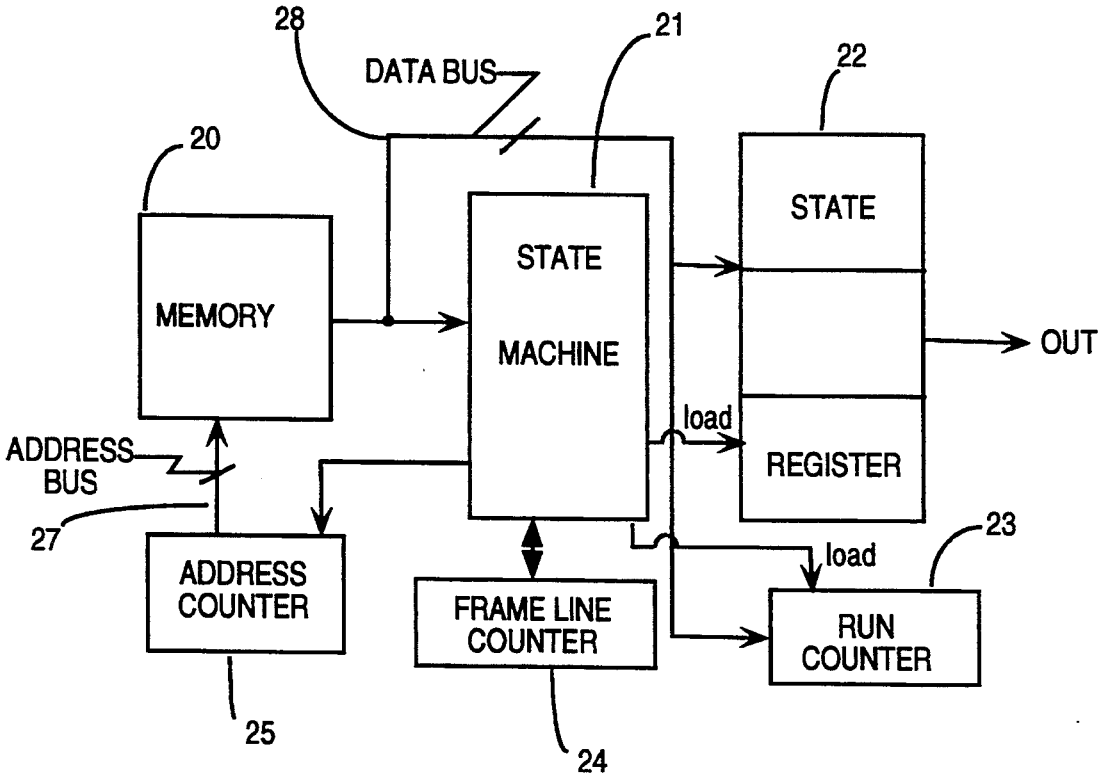
FIGURE 2 (Prior Art)
FIG. 2 shows a typical prior art version of a video timing generator.
Figure 4:
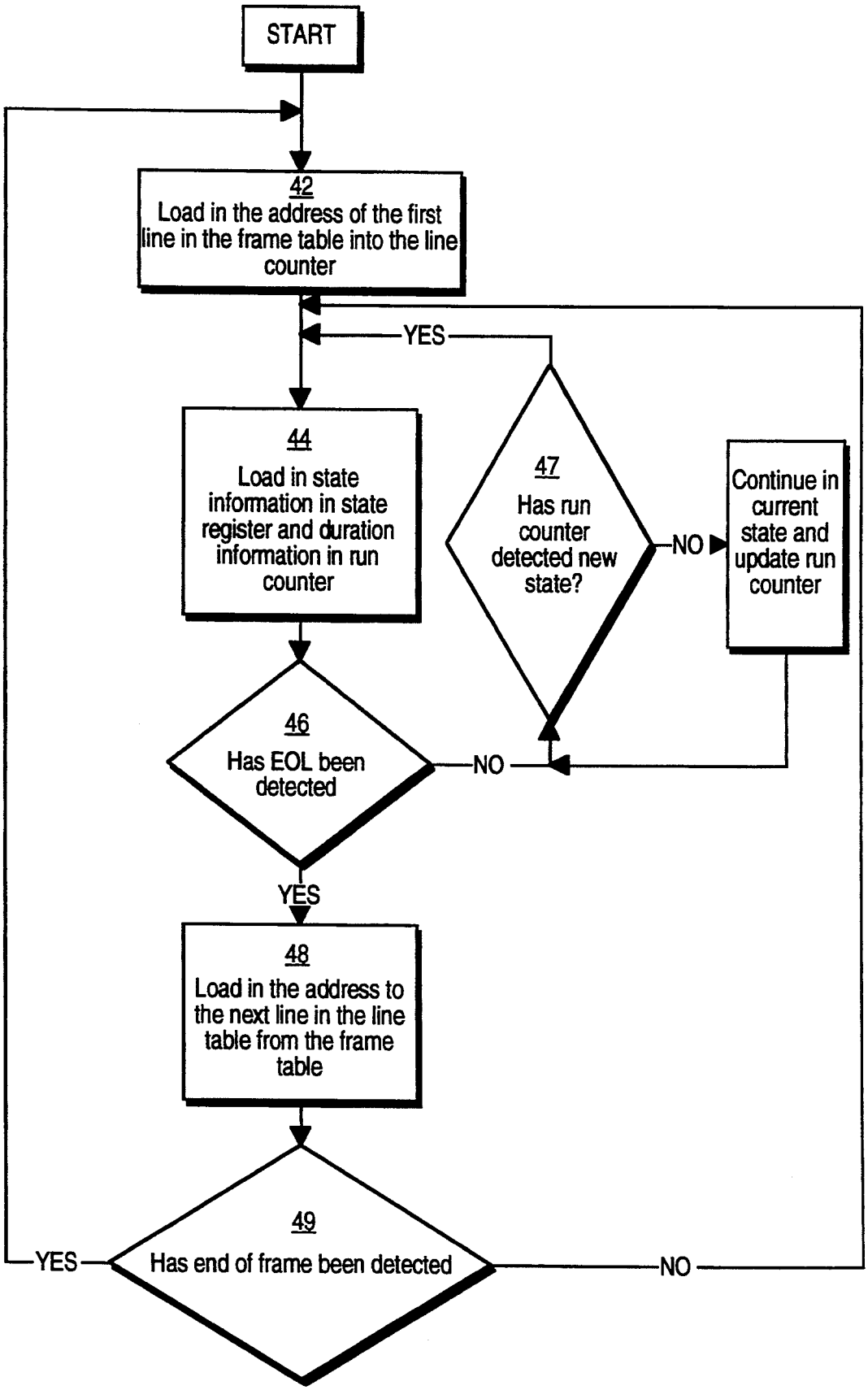
FIGURE 4 (Prior Art)
FIG. 4 shows a flow chart representing the steps taken by the prior art to generate the video timing information.

The display ID information in memory 111 is stored in two different tables shown in FIG. 13. FIG. 13*a* is a typical example of a Scan Line table stored in memory 111 of the preferred embodiment of this invention. It contains two bytes of information representing a word count, which specifies the total length of the entries in a scan line (corresponding to the number of transition records in a scanline), followed by one or more transition records containing two bytes of information. Each transition record (shown as a line of "DID, $X_{13}$start" in FIG. 13*a*) has a 5 bit DID (Display ID) piece of information and 11 bit effective horizontal coordinate denoting the X location at which the DID becomes active. Note that there is no relationship between the scan line entries in memory as there is no sequence between scanlines (such as noncontiguous scanlines) as in the case of the video timing scanline sequences described above. The word count information is loaded in a word counter which is within control logic 117. After each transition record information is loaded into FIFO1 112, the word counter counts down by one until it reaches zero. Once the word counter reaches zero, it signals control logic 117 to load the address to the next line entry from the Frame Table into a scan line entry pointer register in the control logic 117 in order to obtain the next line entry from the Frame Table. The address to the previous entry of the Frame Table and the next (current) entry of the Frame Table are typically maintained in two registers within the control logic 117; this is similar to the way prior art DID video generators kept the address of the previous and current entries of the Frame Table within the state machine 21 of the prior art system shown in FIG. 2.

FIG. 13*b* is a typical example of a Frame Table stored in memory 111 in the preferred embodiment of this invention. Each entry consists of either a two byte pointer to a scan line entry (i.e. a scan line in the scan line table of FIG. 13*a*), or a scan line repeat count denoting the number of times the previous entry pointer should be used. Note that if the most significant bit (bit 15) of the information is equal to zero (0) for each vertical Frame Table element, 15 bit information will be stored in the scan line entry pointer register. Otherwise, the 15 bit information will be loaded into a y counter, representing a scan line repeat count. In this manner, a distinction is made between a pointer to a scanline in the frame buffer and a line repeat count in the frame buffer. Both scan line entry pointer register and Y counter are within control logic 117. If an entry pointer is followed by a repeat count, assuming that repeat count is more than 1 count, the number of repeat count minus one elements following that repeat count will be ignored by the display ID generator. In effect, this causes the control logic 117 to skip over (repeat count −1) entries in the frame table.

Next, using the address to the first scan line entry, a transition record (i.e. the DID and "x start" information which respectively shows the DID and the starting x location along a scan line for the associated DID; the ending location is the next starting x) is transferred into FIFO1 112. Note that each time a transition record information is obtained from memory 111 and is transferred to FIFO1 112, the scan line entry pointer register increments twice since each address points to one byte of information and each transition record contains two bytes of information which allows the scan line entry pointer register to point to the next transition record information. If the output of word counter in the control logic 117 is not equal to zero and if FIFO1 112 is not full, control logic 117 loads the next transition record information into the FIFO1 112. The FIFO1 112 communicates with control logic 117 via the control Line 118 to indicate whether it is full or not. Each entry in FIFO1 112 contains 5 bits of DID information, 8 bits of XDIV5 (X divided by 5) information, and 3 bits of XMOD5 information. Note that XDIV5 is the result of the binary division of the value of X_start and 5, and XMOD5 is the result of X_start modulo 5. Both the division function and the modulo 5 function are done in control logic 117 before the data is stored into FIFO1 112. A single transition record information is then transferred to state machine 113 via control line 118.1 where the XMOD5 and XDIV5 information are used to derive duration information. The transformation of information occurs in the state machine 113.

Figure 14:
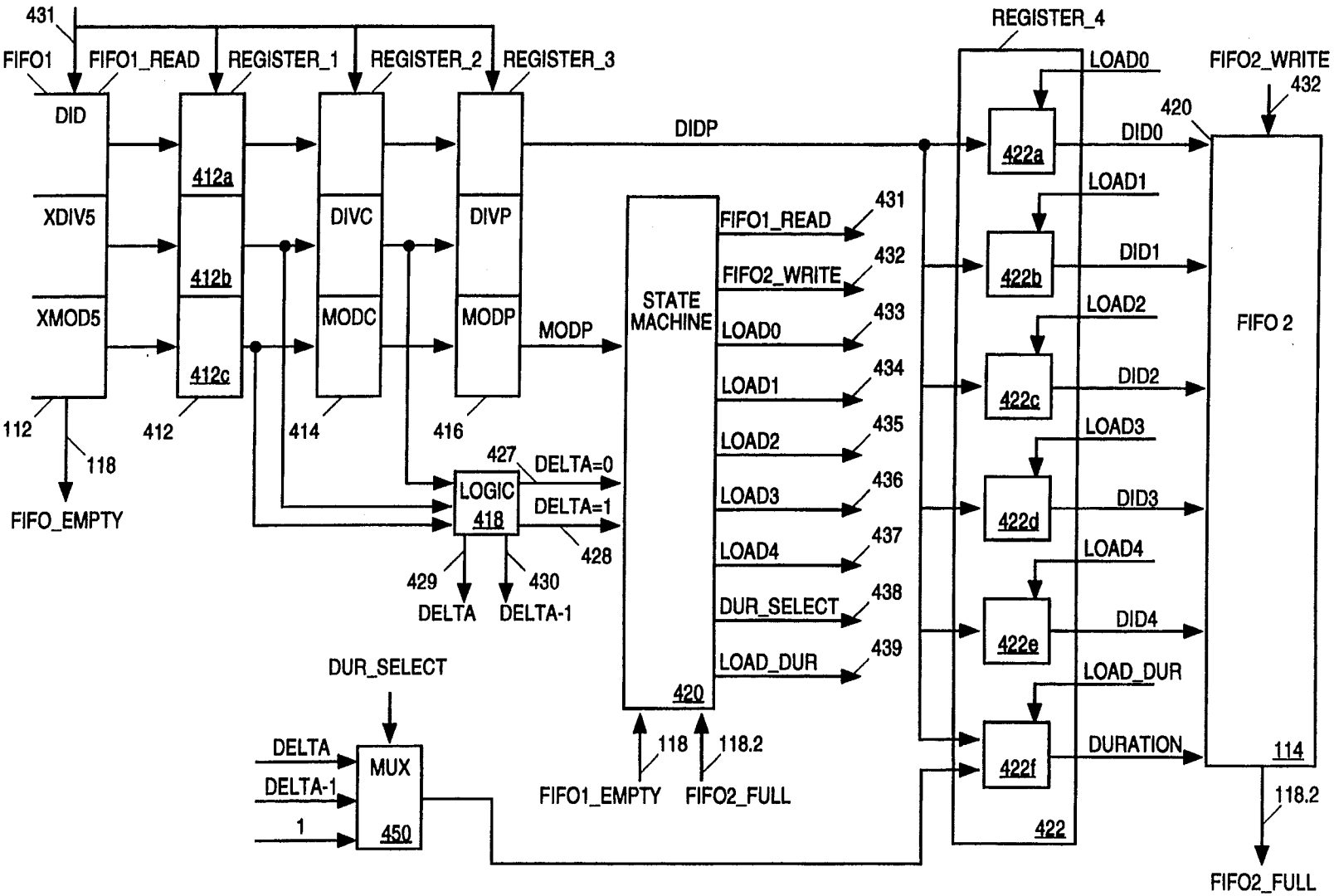
FIG. 14 shows shows a detailed schematic of state machine 113 in FIG. 11.

FIG. 14 shows in more detail a typical state machine 113 from FIG. 11. It includes register 412, register 414, register 416, Logic 418, state machine 420, register 422, and multiplexer (MUX) 450. FIFO1 112 and FIFO2 114 are shown in this FIG. 14 to better understand the function of state machine 113 in FIG. 11.

Before the circuit in FIG. 14 can operate, register 412, register 414, and register 416 have to be loaded with information. The system reads the information from FIFO1 112 and loads them into register 412, register 414, and register 416. Each register will hold one set of information (a transition record) that needs to be generated by the display ID generation. Each set of information includes 5 bits representing DID, 8 bit representing XDIV5 (X_start divided by 5), and 3 bits representing XMOD5 (X_start Modular 5). Each register is partitioned according to the number of bits that represent DID, XDIV5, and XMod5. For example, register 412 holds DID information in section 412*a*, holds XDIV5 in section 412*b*, and holds XMod5 in section 412*c*. The same setup is used for register 414, and register 416.

In a preferred embodiment of the present invention the information in register 416 is referred to as previous information and the information in register 414 is referred to as current information. Further in FIG. 14, XDIV5 and XMOD5 in register 414 are addressed as DIV C and MOD C respectively, and XDIV5 and XMOD5 in register 416 are addressed as DIV P and MOD P respectively. Each time the system reads from FIFO1 112, the information in register 412 is shifted to register 414 and the previous information in register 414 is shifted to register 416. Register 412 holds the new set of information and register 416 loses its old content after each read cycle by the state machine 420.

Once the three initial sets of information are loaded in the three registers, Logic 418 uses MOD C, DIV C, and DIV P to generate delta, and delta-1 that are represented by signal lines 429, and 430 respectively and logic 418 provides a signal indicating whether delta=0 or delta=1 over signal lines 427 and 428 respectively. State machine 420 receives MOD P, delta=0, and delta=1 information and decides on the duration that each set of five DID information is valid. A set of five DID values (from 5 DID transition records) is called a row of DID information and a row of DID information plus the duration information is what is written into FIFO2 114. Using the information provided to state machine 420, it generates a number of signals to control loading of register 422, selection of one of the inputs to MUX 450, the process of reading data from FIFO1 112, and the process of writing data into FIFO2 114. When the state machine 420 generates the load commands (load0 433, load1 434, load2 435, load3 436, and load4 437) DID P will be loaded in the individual registers of register 422 (i.e. 422*a*, 422*b*, 422*c*, 422*d*, and 422*e*). It will be appreciated that all load signals are not asserted at the same time in every load operation. State machine 420 determines which load signal will be asserted.

Once state machine 420 loads a row of DID information in registers 422*a* through 422*e*, it has to load the duration information in register 422*f* which is called the duration register. The output of MUX 450 supplies the input to the register 422*f*. Dur_select 438 (duration select) signal selects one of the three inputs to MUX 450 and allows that input to appear at the output of MUX 450. To load the duration information in the duration register 422*f*, state machine 420 asserts load_Dur 439 (load duration) signal. Once all registers are loaded, state machine 420 checks to see whether FIFO2 114 can be written into with the information held by register 422. If FIFO2 114 is not full (can be loaded with the information), state machine 420 asserts FIFO2_write 432 signal line to enable FIFO2 114 to accept the information held by register 422. Subsequently, FIFO2 114 passes the information to DID register 115 and run counter 116 upon commands from control logic 117 or run counter 116 in FIG. 11 (in the same manner as described for the video timing generator of FIG. 6).

Figure 15A:
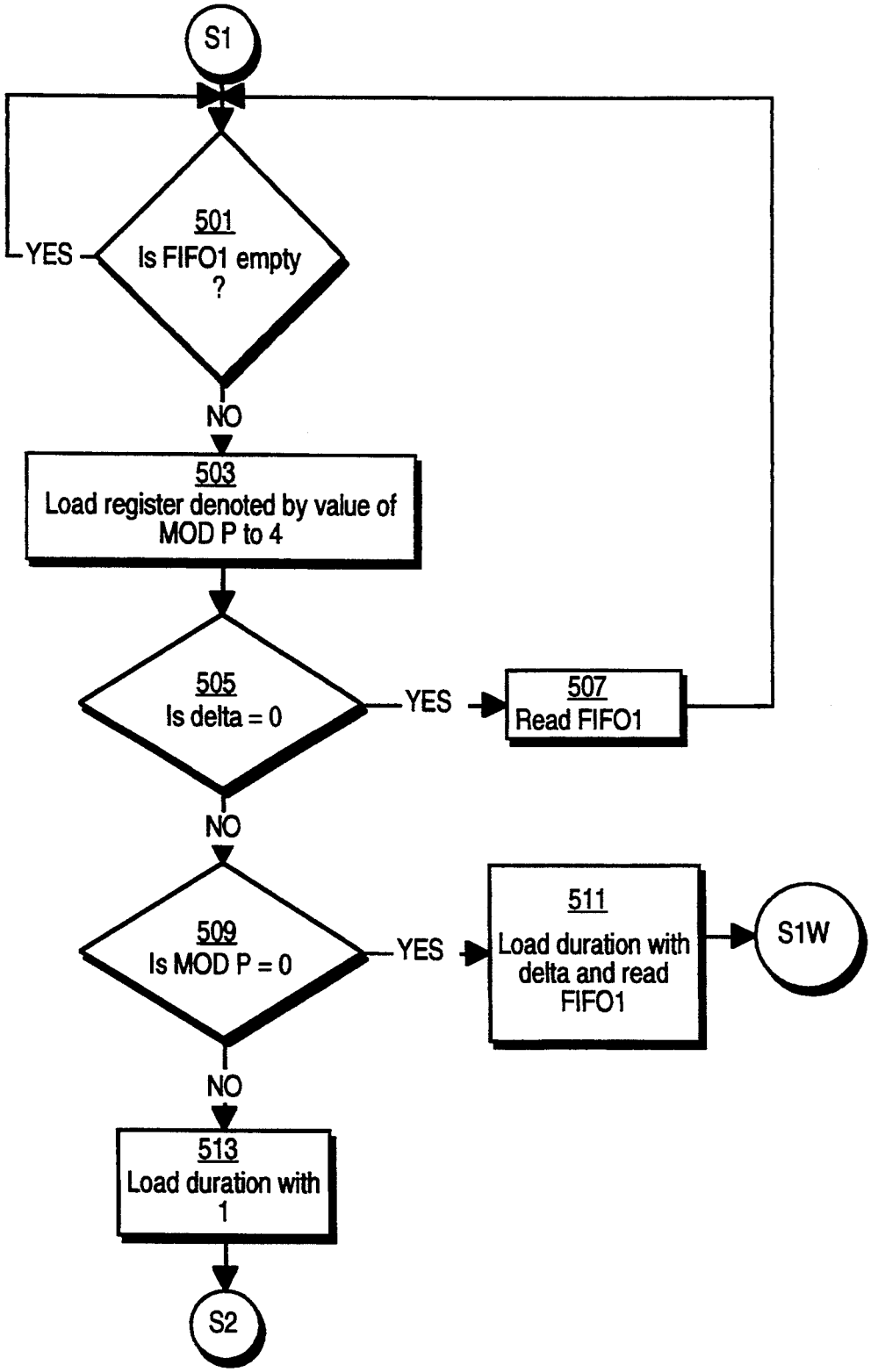
FIGS. 15*a*, 15*b* and 15*c* show a flow chart of the different states that the state machine 420 enters in generating the duration information.

The process of generating the duration information and other signals by the state machine 420 will now be described. The state machine 420 determines the duration and generates all the necessary signals shown in FIG. 14 according to the process shown in the flow charts in FIGS. 15*a*, 15*b*, and 15*c*. State machine 420 starts in state S1 (FIG. 15*a*) at the beginning of every scan line. First, state machine 420 checks to see whether there is any information in FIFO1 112 (step 501). If FIFO1 112 is empty, state machine 420 waits until FIFO1 112 is loaded with DID and X_start information. Next, state machine 420 loads registers 422*a* through 422*e* with DID P information (step 503). In loading the registers, state machine 420 begins with a register number that is equivalent to the value of MOD P and ends with register 422*e*. It is appreciated that if MOD P holds a value of 0, register 422*a*is selected; if MOD P holds a value of 1, register 422*b* is selected; if MOD P holds a value of 2, register 422*c* is selected; if MOD P holds a value of 3, register 422*d* is selected, and if MOD P holds a value of 4, register 422*e* is selected. Usually at the beginning of each line MOD P is 0 since the first DID on a scan line starts normally at X_start equal to zero. Consequently, at the start of each scan line state machine 420 loads registers 422*a* through 422*e* with the DID P information.

As was mentioned before, logic 418 generates delta, which is the difference between DIV C and DIV P, using DIVC and DIVP information from registers 414 and 416 respectively. State machine 420 makes its initial decisions based on the value of delta. If delta is zero (yes of step 505), state machine 420 knows that current and previous information are the same, and that it cannot do anything unless it reads a new set of information and finally proceeds to read a new set of information from FIFO1 112 (step 507). The new information is loaded in register 412 which causes the previous content of register 412 to be loaded into the register 414 which is now the new current information. The previous content of register 414 will be loaded into register 416 and is now the new previous information. After state machine 420 reads new information, it goes back to the beginning of state S1 and once again loads registers 422*a* through 422*e* and checks the value of delta. If the value of delta is equal to zero, state machine 420 repeats the above process (step 507), otherwise it proceeds to check the value of MOD P (step 509).

If the value of MOD P is zero, state machine 420 knows that the content of registers 422*a* through 422*e* should be written into FIFO2 114. Subsequently, state machine 420 loads duration register 422*f* with the value of delta (step 511), does another read from FIFO1 112 (step 511), and goes to S1W state. If MODP is not equal to zero, state machine 420 knows that either a new DID information has to be loaded in some of the individual registers of register 422 or previous DID information has to be used in a new row of DIDs after the current row is written into FIFO2 114. So, state machine 420 loads duration register 422*f* with a value of 1 (step 513) and proceeds to state S2.

Figure 15B:
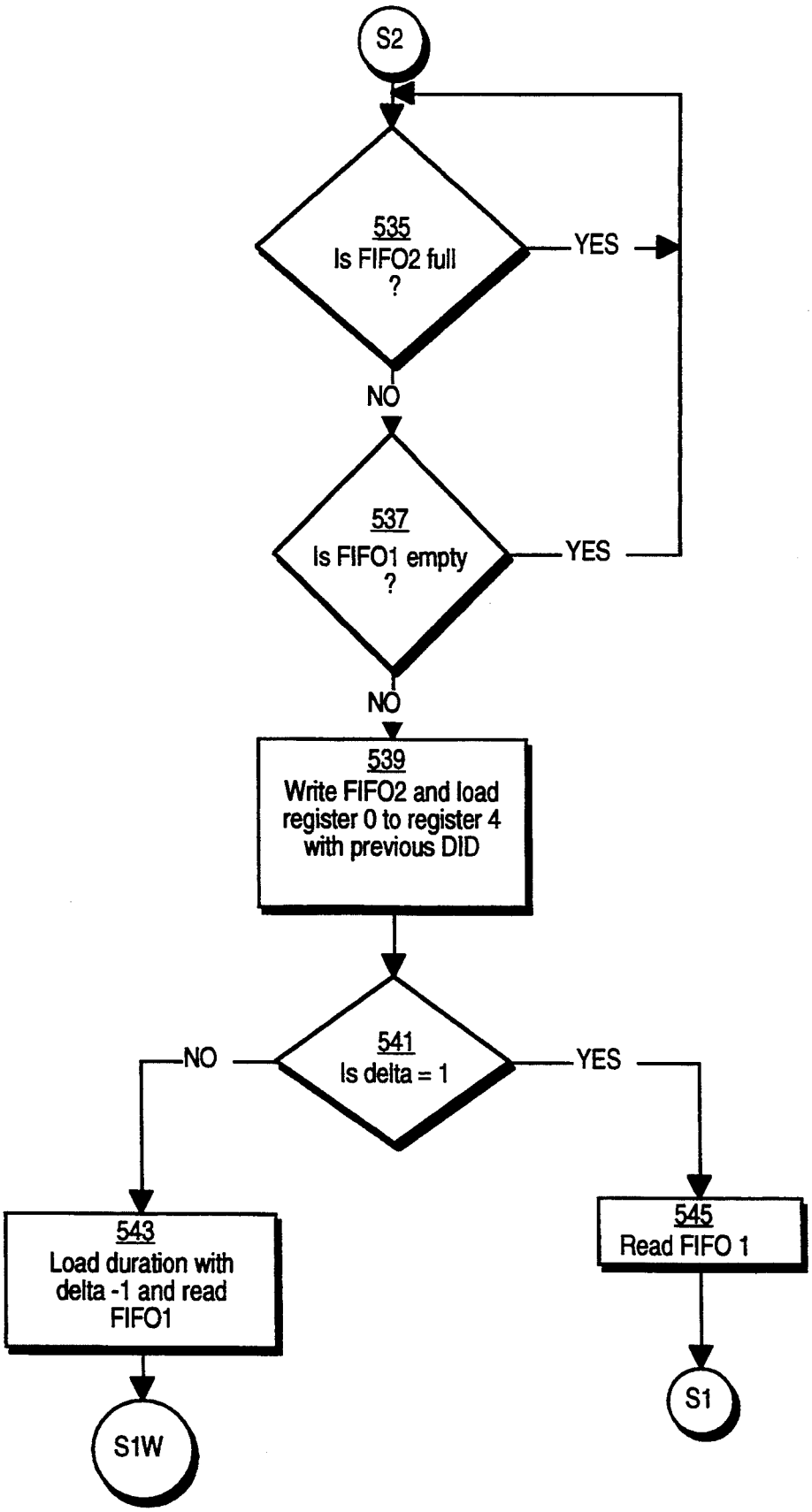
Figure 15C:
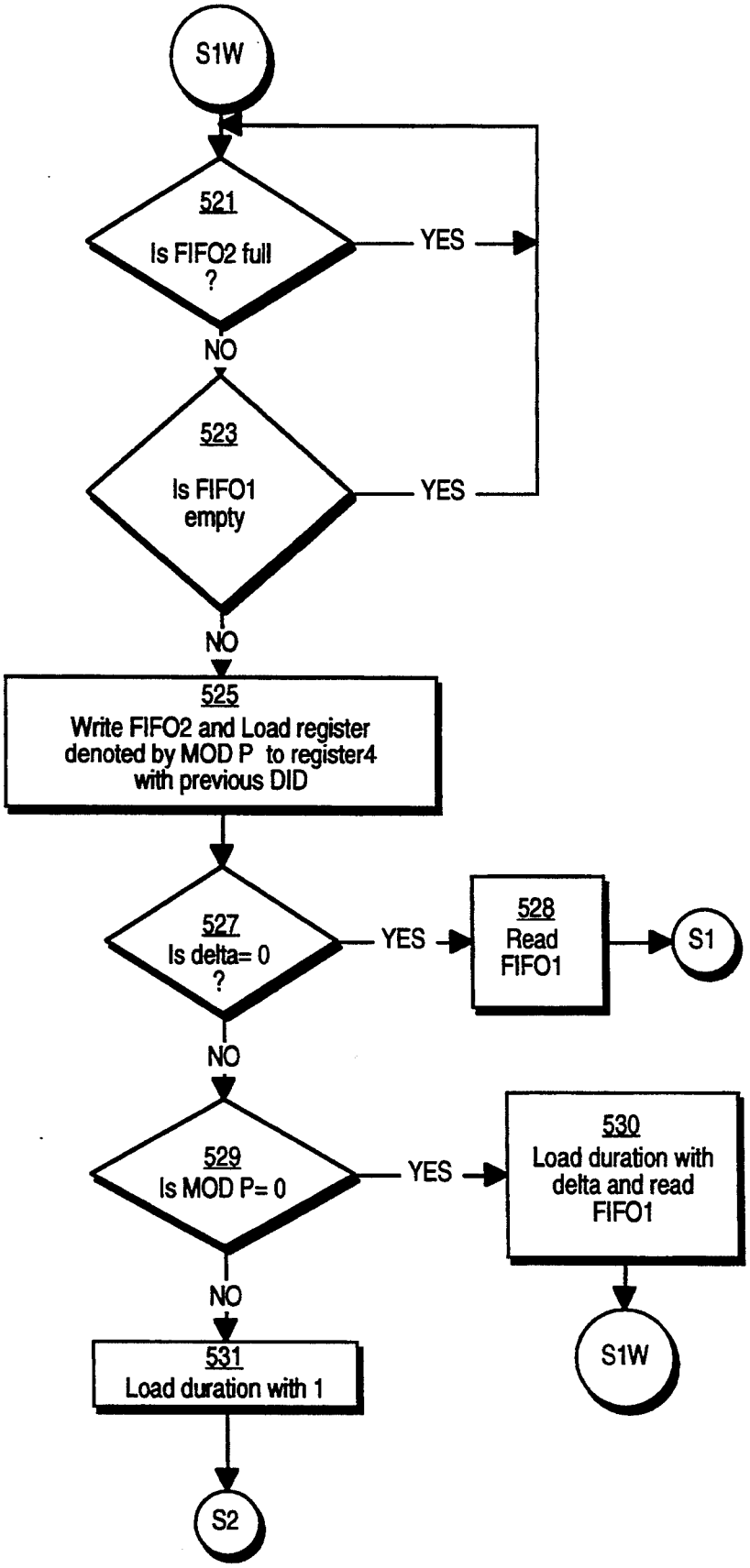

In the situation where MOD P is equal to zero, the state machine 420 loads the duration register 422*e* with the current value of delta, reads FIFO1 112, and proceeds to state S1W, the processing of which is shown in FIG. 15*c*. The state S1W functions exactly the same way as state S1 except that at the beginning of this state, state machine 420 checks FIFO1 112 and FIFO2 114 to see whether they are ready to supply and receive information respectively (steps 521 and 523). If either condition is satisfied (i.e. the answer to "Is FIFO1 empty?" or "Is FIFO2 full?" is yes), the state machine 420 goes back to the beginning of state S1W until both conditions fail (i.e. the answer to both questions is no). Once both conditions fail, state machine 420 writes the content of register 422 in FIFO2 114 (step 525). After this step, S1W state functions (in steps 527–531) exactly the same way as state S1 does which was explained above.

Going back to the situation where MOD P is not equal to zero in state S1, the state machine 420 loads the duration register 422*f* with a value of 1 (step 513 or step 531) and proceeds to the state S2, which is shown in FIG. 15*b*. Here, the state machine 420 again checks to see whether FIFO2 is full (step 535) or FIFO1 is empty (step 537) and waits until both conditions fail before it proceeds to the next step, which is step 539. If FIFO2 114 can accept information, state machine 420 writes to FIFO2 114 (step 539) since all registers in register 422 are loaded and ready to dump their content into FIFO2 114. At this stage, state machine 420 proceeds to examine the value of delta (step 541).

If the value of delta is one, state machine 420 enters state S1 after it reads FIFO1 112 once again in step 545. If the value of delta is not one, state machine 420 loads duration register with delta-1, reads FIFO1 112 again (step 543), and proceeds to state S1W to write the current content of register 422 into FIFO2 114 and to proceed with further transformation of information.

In this process, state machine 420 communicates with FIFO2 114 via signal lines 432 and 118.2 to write into FIFO2 114 and to receive information on whether or not FIFO2 114 is full. Further, the state machine 420 communicates with FIFO1 112 via signal lines 431 and 118 to read from FIFO1 112 and to check whether FIFO1 112 is empty.

Figures 16A, 16B:
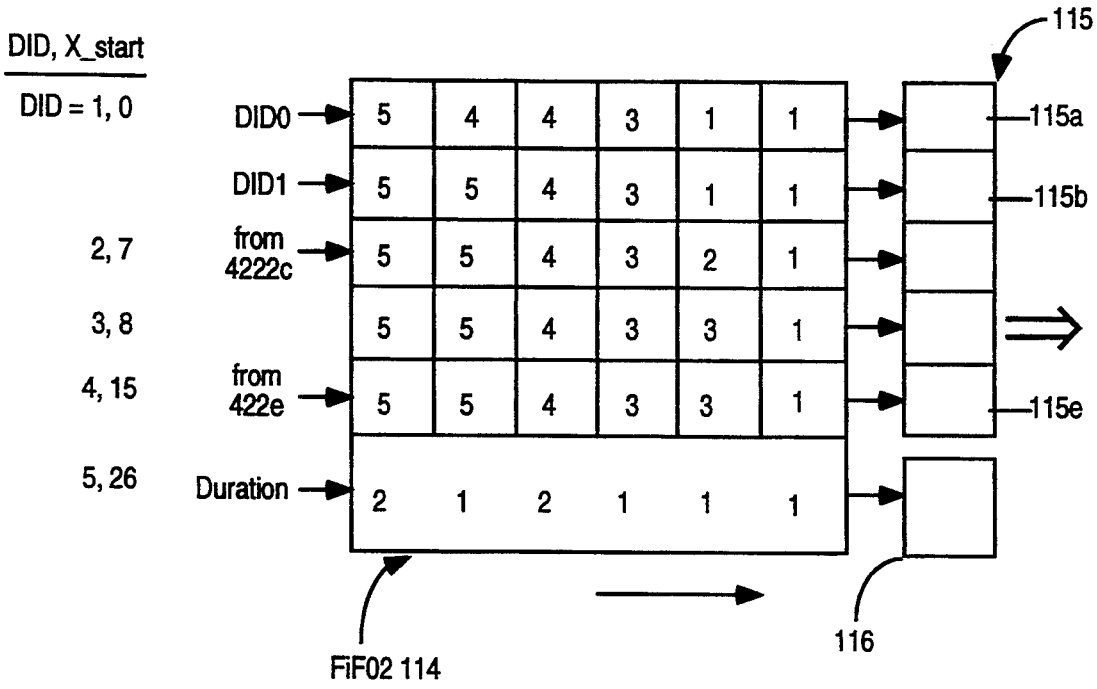
FIG. 16*a* shows an example of DID information for a scan line of 40 pixels and FIG. 16*b* shows the FIFO2 and register 115 and counter 116 for this example.

Last, the information in FIFO 114 is then loaded into DID register 115 and Run Counter 116 of FIG. 11. In this process, DID register 115 contains the information about the display ID for a group of consecutive pixels and Run Counter 116 contain the duration information (the number of pixels in the group). The output of DID register 115 is the display ID information used by the video controller 12 of FIG. 1. FIG. 16*a* shows an example of DID information for a scan line of 40 pixels. It can be seen that the first set of pixels (from pixel "0" to pixel "6") has a DID value of "1", and the next set of pixels (a single pixel, which is pixel 7) has a DID value of "2", etc. It will be appreciated that the information is FIFO 2 must reflect the sequence of DID values for 5 groups of DID sequences. FIG. 16*b* shows an example of FIFO2 114 has been loaded according to the method described in conjunction with FIGS. 15*a*, 15*b* and 15*c*. It can be seen that the register 422*a*, 422*b*, etc. feed the left side of FIFO2 114—so that FIFO2 114 contains the DID information and the duration information shown in FIG. 16*b*. The FIFO2 114 then loads the state register 115 (so that information stored in register 115*a* comes from register 422*a*, etc) and loads the run counter 116. It will be appreciated that the run counter 116 is counted at typically a clock rate which is slower than the pixel clock rate (e.g. the counter 116 is clocked at a state clock rate one-fifth of the pixel clock rate) and that a 0 to 4 counter (clocked at the pixel clock rate) acts as the select line to select the input of a 5 to 1 multiplexor which is coupled to the 5 outputs of register 115 in order to serialize the output of DID register 115 to provide a stream of DIDs (see applicant's copending application Ser. No.: 07/732,793, filed Jul. 19, 1991).

Figure 12:
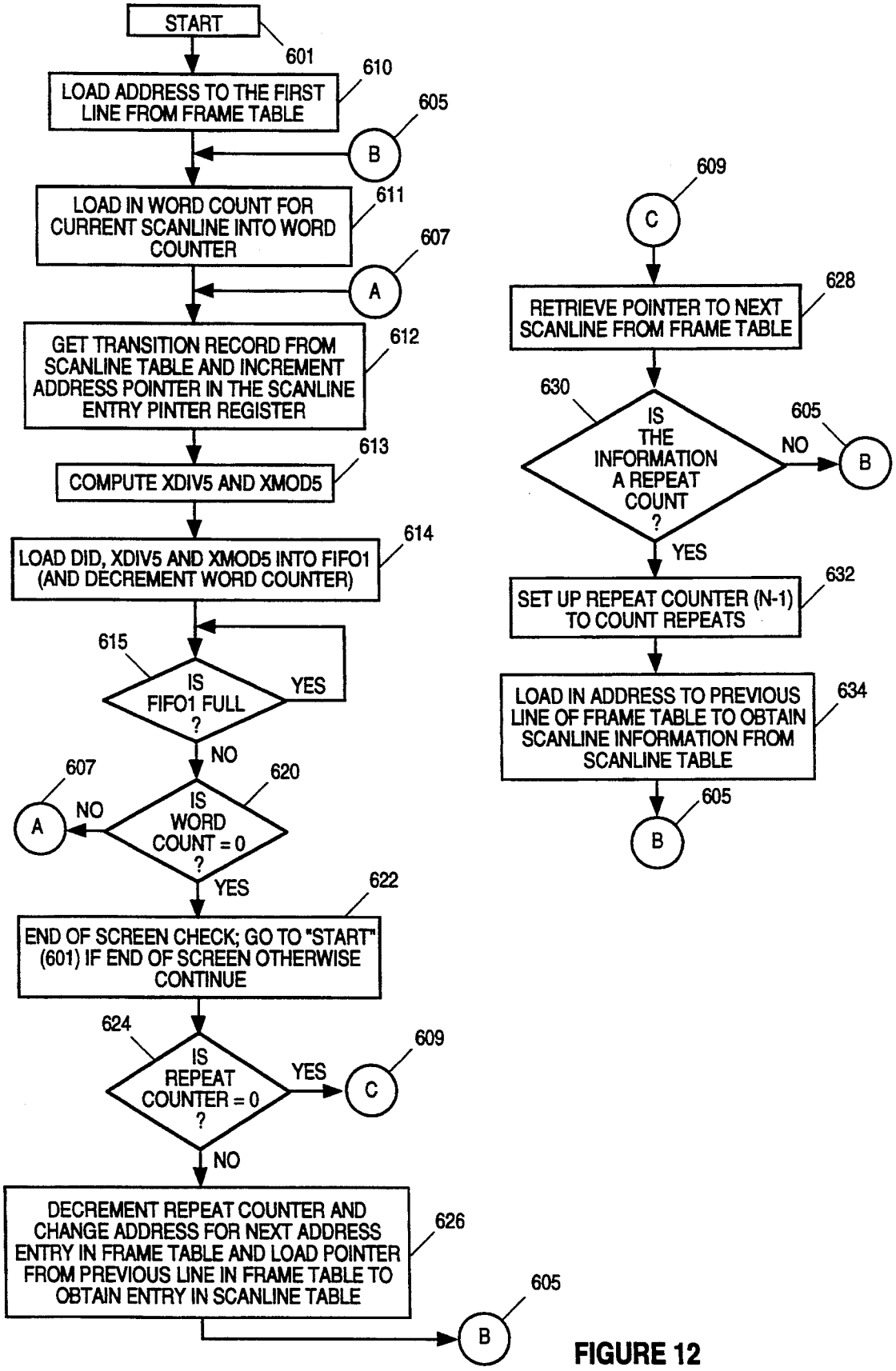
FIG. 12 shows a flow chart representing the steps taken in the method of the preferred embodiment of the present invention in generating the display ID information.

The flow chart of FIG. 12 shows the steps taken by the Display ID generator, and particularly the control logic unit 117, to provide the display ID information from memory 111 to FIFO1 112; the transfer of information from FIFO1 112 to FIFO2 114 and then to register 115 and run counter 116 has been described above in reference to FIGS. 15*a*, 15*b* and 15*c*.

The display ID generator starts by reading the address (pointer) to the first scanline from the Frame Table (step 610) and storing that address in an address counter (which includes the scanline entry pointer register) in the control logic unit 117 of FIG. 11. Then, the word count information (which appears at the beginning of the first line in the scanline table as shown in FIG. 13*a*) is loaded into the word counter, as shown by step 611, in control logic unit 117. Having the address to the first line and the word count, the control logic unit 117 obtains a transition record (i.e. one DID information and one X_start information) from the scanline table and increments the address pointer in the scanline entry pointer register so that the register contains the address of the next transition record (step 612).

Then, in step 613, control logic unit 117 computes XDIV5 and XMOD5 from the X_start information, and, in step 614, the control logic unit 117 loads the DID information, as well as the XDIV5 and XMOD5 values, into FIFO1 112 and decrements the word counter. In step 615, control logic 117 determines whether FIFO1 112 is full; if it is full, then step 615 is repeated until there is space (not full) in FIFO1 112. When FIFO1 is not full, processing proceeds to step 620, in which the word counter is checked to determine whether it is equal to zero. If "word count=0" then control logic 117 performs an end of screen check in step 622; if the word count is not equal to zero (indicates processing of DID for current scanline is not complete) then processing progresses from step 620 to step 612 (through node "A", labelled as 607) which has been described above. If "word count=0", this indicates that a scanline has been completed and another scanline should begin; the number of times the word count hits (equal) zero indicates the number of scanlines which have been processed since the first scanline of a screen full of scanlines and this number may be compared against the total number of scanlines in a raster display screen to determine whether the end of a screen has been reached. The end of screen check is performed by determining the number of scanlines which have been read from the scanline table since the beginning of the current rasterization of a screen full of scanlines. If the end of a screen has been reached, control logic 117 goes back to "start" (601) to begin the process of loading the FIFO1 112 for the next rasterization of a screen full of scanlines. If step 622 determines it is not the "end of screen", then processing continues to step 624 in which the line repeat counter is checked for being equal to zero. This counter is set by a line repeat count being present in the frame table (such as the line repeat counts shown in FIG. 13*b*). If the "repeat counter=0" then a prior scanline of DIDs does not have to be repeated and processing moves from step 624 to step 628 (through node C, labelled 609). If the repeat count does not equal zero then a prior scanline must be repeated and this occurs by moving to step 626, in which the control logic 117 decrements the repeat counter and changes the address for the next address entry in the frame table so that the next address register (for addressing the frame table) points to the next address. Changing the address in this manner causes the control logic 117 to skip over N−1 entries in the frame table (as described above), where N=original repeat count from frame table. Also in step 626, the control logic 117 uses the address to the previous pointer (not a repeat count) in the frame table to obtain the previous scanline entry in the scanline table. After step 626, processing moves to step 611 (through node B, labelled 605). At step 628, control logic 117 retrieves the information at the next address location in the frame table, which information may be a pointer to the next scanline (or perhaps a line repeat count); as noted above the control logic 117 will keep track of the next address and the previous address location (which contains a pointer to the last scan line entry used from the scanline table) in the frame table in a manner which is similar to the prior art state machine 21 shown in FIG. 2. Then, in step 630, control logic 117 determines whether the information in the frame table at the next address location is a pointer to the scanline table or a line repeat count. If the information is a pointer (and hence not a repeat count) then processing continues from step 630 to step 611 (through node B). At this point, typically the previous address location of the frame table is set equal to the current address location of the frame table and the current address location is changed so that it is the next location in the table. If, on the other hand, the information is a repeat count then, in step 632, the control logic 117 sets up the repeat counter by storing N−1 in the counter, where N is the number of repeat counts for the previous scanline which was just stored in FIFO1 112. Then, in step 634, the control logic 117 uses the previous address location in the frame table (which contains the pointer for the previous scanline) to obtain the scanline information from the scanline table. At this point, processing reverts back to step 611 as show in FIG. 12.

It will be appreciated by those skilled in the art that control logic 117 may be implemented in random logic gates or, move practically, as a state machine built according to the flow chart of FIG. 12 using the well known tools for designing state machines, such as those made from programmable logic arrays.

The discussed apparatus and method for generating display ID information eliminates the problem of selecting a memory that can function at a high pixel clock rate. The preferred embodiment of the present invention allows the transfer of information from memory 111 to FIFO 112 (see FIG. 11) at a slower clock rate than the pixel clock rate. However, the FIFO 114 has to be able to transfer information to DID register 115 and run counter 116 at a maximum pixel clock rate. A FIFO that can operate at a high pixel clock rate can be obtained from the available technology, whereas a random access memory that operates at such high clock rate might not be available. Furthermore, since the memory does not have to operate at a such high clock rate, it can be shared with other modules of video controller 12 in FIG. 1. Since there is no need for the memory in present invention to operate at high clock rates and since it can share its storage capacity, the present invention is more cost effective and can be realized much easier. An apparatus and a method of generating video timing information and display ID information has been explained.

I claim:

1. In a raster-scanned display system, an apparatus retrieving data for generation of timing signals for said raster-scanned display system, said apparatus comprising:

a first memory for storing an entire timing information representing said timing signals;

a second memory for storing a portion of said entire timing information, said portion containing timing signal information for a first raster-scanned line of a first plurality of raster-scanned lines, said first plurality of raster-scanned lines defining a frame of display information, each raster-scanned line of said first plurality of raster-scanned lines comprising at least one state information and at least one duration information;

a third memory for storing a single state information for said first raster-scanned line; and a control unit for coupling said portion of said entire timing information from said first memory to said second memory, and for coupling said single state information from said second memory to said third memory, said control unit comprising;

control logic circuits for controlling transfer of said portion of said entire timing information from said first memory to said second memory, and for controlling transfer of a first of said single state information from said second memory to said third memory;

a register for receiving said portion of said entire timing information from said first memory;

a line sequence counter for sequentially counting down a number of lines in a second plurality of raster-scanned lines, said second plurality of raster-scanned lines defining a sequence of lines, said line sequence counter coupled to said control logic circuits; and a frame counter for sequentially counting down a number of lines in said first plurality of raster-scanned lines, said first plurality of raster-scanned lines including said second plurality of raster-scanned lines, said frame counter coupled to said control logic circuits.

2. An apparatus as in claim 1 wherein said first memory is comprised of random access memory, said apparatus further comprising a circuit for sequentially counting a single duration information which corresponds to a duration of said single state information.

3. An apparatus as in claim 1 wherein said second memory is a FIFO.

4. An apparatus as in claim 1 wherein said third memory is comprised of a register.

5. An apparatus as in claim 2 wherein said circuit for sequentially counting is comprised of a run counter.

6. In a computer-controlled display system, an apparatus retrieving data for generation of video timing signals for said computer-controlled display system, said apparatus comprising:

a first memory for storing an entire video timing information representing said video timing signals;

a first register coupled to said first memory by a control unit which addresses said first memory to obtain a first portion of said entire video timing information, said control unit loading said first portion of said entire video timing information into said first register, said first portion containing information for a first line in a first plurality of lines, said first plurality of lines defining a frame of display information, each line of said first plurality of lines comprising at least one state information and one duration information;

a line sequence counter coupled to said control unit, wherein said control unit addresses said first memory to obtain a second portion of said entire video timing information, said control unit loading said second portion of said entire video timing information into said line sequence counter, said second portion of said entire video timing information representing a total number of lines in a second plurality of lines defining a sequence of lines;

a frame counter coupled to said control unit, wherein said control unit addresses said first memory to obtain a third portion of said entire video timing information, said control unit loading said third portion of said entire video timing information into said frame counter, said third portion representing a total number of lines in said first plurality of lines, said first plurality of lines including said second plurality of lines;

a FIFO coupled to said first register, wherein said control unit generates a first control signal to load said first portion of said entire video timing information from said first register into said FIFO;

a second register coupled to said FIFO wherein said control unit generates a second control signal to load an initial state information into said second register, said initial state information representing a first state information for said first line; and a run counter coupled to said second register wherein said control unit generates said second control signal to load an initial duration information into said run counter, said initial duration information representing a first duration information for said first line.

7. An apparatus as in claim 6 wherein said first memory stores said entire video timing information, said entire video timing information comprising at least a line sequence table and a frame table, said line sequence table defining said sequence of lines, said frame table defining a plurality of sequences of lines.

8. An apparatus as in claim 7 wherein information in said line sequence table comprises:

at least one byte representing a single state information;

at least one byte representing a single duration information;

at least one byte of information signaling an end of one of said second plurality of lines, and at least one byte of information pointing to a next one of said first plurality of lines.

9. An apparatus as in claim 7 wherein information in said frame table comprises:

at least one byte of said third portion of said entire video timing information representing said total number of lines in said first plurality of lines defining said frame;

at least one byte of a fourth portion of said entire video timing information representing an address of said sequence of lines; and at least one byte of said second portion of said entire video timing information representing said total number of lines in said second plurality of lines defining said sequence of lines.

10. An apparatus as in claim 6 wherein said FIFO stores at least said first portion of said entire video timing information.

11. An apparatus as in claim 6 wherein said run counter generates a control signal to enable loading a single state information from said FIFO to said second register and to enable loading a single duration information from said FIFO to said run counter after an initial step of loading said initial state information and said initial duration information.

12. In a computer-controlled display system, a method for retrieving data for generation of video timing signals for said computer-controlled display system, said method comprising:

accessing a first memory to obtain a portion of an entire video timing information representing said video timing signals from said first memory, said entire video timing information comprising one frame of information, said portion containing information for a first line of a plurality of lines, each line of said plurality of lines comprising at least one state information and at least one duration information, wherein said plurality of lines comprise a line sequence;

loading said portion of video timing information into a first register;

loading said portion of video timing information into a second memory from said first register, wherein said second memory is a FIFO;

loading a single state information representing one state of video timing signals for said first line from said second memory into a third memory;

loading a single duration information representing a duration of said single state information from said second memory into a run counter;

sequentially counting down said run counter;

sequentially counting down a line sequence counter initially loaded with a value representing a number of lines in said plurality of lines comprising said line sequence; and sequentially counting down a frame counter initially loaded with a value representing a number of lines in said entire video timing information that comprise said frame of information.

13. A method as in claim 12 wherein said first memory is comprised of random access memory.

14. A method as in claim 12 wherein said third memory is a register.

* * * * *